US006976434B2

(12) United States Patent
Roig et al.

(10) Patent No.: US 6,976,434 B2
(45) Date of Patent: Dec. 20, 2005

(54) FLOATING AMPHIBIOUS GAME TABLE

(75) Inventors: Antonio J. Roig, Ponce, PR (US); Salvador Vassallo, Coto Laurel, PR (US)

(73) Assignee: Vassallo Research & Development Corporation, Coto Laurel, PR (US)

( * ) Notice: Subject to any disclaimer, the term of this patent is extended or adjusted under 35 U.S.C. 154(b) by 0 days.

(21) Appl. No.: 10/616,510

(22) Filed: Jul. 9, 2003

(65) Prior Publication Data

US 2004/0173123 A1 Sep. 9, 2004

Related U.S. Application Data

(60) Provisional application No. 60/451,242, filed on Mar. 4, 2003.

(51) Int. Cl.[7] ..... A47B 85/00
(52) U.S. Cl. ..... 108/25
(58) Field of Search ..... 108/25, 26, 43, 108/44, 156, 157.1, 153.1; 273/236, 285; 441/32, 136

(56) References Cited

U.S. PATENT DOCUMENTS

| | | | | |
|---|---|---|---|---|
| 1,762,776 | A | 6/1930 | Gardner | |
| D215,959 | S | 11/1969 | Kelso | |
| 3,687,092 | A * | 8/1972 | Manning | 108/156 |
| 3,780,686 | A | 12/1973 | Brill | |
| 3,858,877 | A | 1/1975 | Lundstrom | |
| 3,875,873 | A * | 4/1975 | Howitt | 108/25 |
| 4,011,821 | A | 3/1977 | Neal | |
| D259,497 | S | 6/1981 | Mahler | |
| 4,358,866 | A | 11/1982 | Rhodes | |
| 5,117,775 | A | 6/1992 | Northam et al. | |
| D339,172 | S | 9/1993 | Roberts et al. | |
| 5,299,588 | A | 4/1994 | MacLeod | |
| D353,406 | S | 12/1994 | Roberts et al. | |
| 5,421,270 | A * | 6/1995 | Kelly | 108/25 |
| D366,190 | S | 1/1996 | Vance et al. | |
| 5,505,645 | A | 4/1996 | Engler, Jr. | |
| 5,509,376 | A * | 4/1996 | Tsengas | 108/156 |
| D373,694 | S | 9/1996 | Grosfillex | |
| 5,556,181 | A * | 9/1996 | Bertrand | 108/25 |
| D401,787 | S | 12/1998 | Zarker, Jr. et al. | |
| D406,709 | S | 3/1999 | Zarker, Jr. et al. | |
| 5,918,550 | A * | 7/1999 | Weir et al. | 108/42 |
| D415,370 | S | 10/1999 | Zarker, Jr. | |
| D425,334 | S | 5/2000 | Ismail | |
| D427,811 | S | 7/2000 | Ismail | |
| D430,759 | S | 9/2000 | Zarker, Jr. | |
| 6,139,382 | A | 10/2000 | Eschbacher et al. | |
| 6,460,471 | B1 * | 10/2002 | Yang | 108/156 |
| 6,595,143 | B2 * | 7/2003 | London | 108/25 |
| 6,662,732 | B2 * | 12/2003 | Birsel et al. | 108/25 |

* cited by examiner

*Primary Examiner*—Jose V. Chen
(74) *Attorney, Agent, or Firm*—Roylance, Abrams, Berdo & Goodman, L.L.P.

(57) ABSTRACT

A floating amphibious game table is provided that may be used on both land and water. The game table has a base member that has an upper surface and a lower surface. A plurality of upper openings in the upper surface of the base member are adapted to receive beverage containers. A plurality of lower openings in the lower surface of the base member are adapted to receive a plurality of legs. The game table floats to allow for use on water. The game table receives the plurality of legs to allow for use on land.

51 Claims, 8 Drawing Sheets

FLOATING AMPHIBIOUS GAME TABLE

RELATED APPLICATION

This application claims the benefit under 35 U.S.C. §119 (e) of U.S. Provisional No. 60/451,242, filed Mar. 4, 2003.

FIELD OF THE INVENTION

The present invention relates to a floating amphibious table. More particularly, the present invention relates to a floating amphibious game table having removable legs that are adapted to be received by resilient tabs on the table when the legs are not required for use. Still more particularly, the present invention relates to a floating amphibious game table having upper openings for receiving beverages and substantially superposed lower openings for receiving the legs.

BACKGROUND OF THE INVENTION

Floating tables have been proposed for use in swimming pools, lakes, beaches, and the like, for recreational purposes. For example, U.S. Pat. No. 3,858,877 to Lundstrom describes a floating table that may be used as either a ping pong table or a pool table in a swimming pool. U.S. Pat. No. 5,299,588 to MacLeod describes a floating sunshade assembly that has recesses for holding beverage containers and the like. However, such tables would not be suitable for use on land. Such tables would have to be placed directly on the ground, and thus, discourages its use on land. Thus, a need exists for a floating game table that may be used both in a water environment, and is easily adapted for use as a game table on land.

SUMMARY OF THE INVENTION

A floating amphibious game table is provided that may be used on both land and water. The game table has a base member that has an upper surface and a lower surface. A plurality of upper openings in the upper surface of the base member are adapted to receive beverage containers. A plurality of lower openings in the lower surface of the base member are adapted to receive a plurality of legs. The base member may be either solid or hollow, but is preferably hollow. The game table floats to allow for use on water. The game table receives a plurality of legs to allow for use on land.

In another preferred embodiment, a floating amphibious game table is provided that has a base member having an upper surface and a lower surface. The upper surface has an inner portion and an outer portion, with the inner portion being higher than the outer portion. A plurality of protrusions extend downwardly from the lower surface of the base member and have a plurality of lower openings therein. A plurality of upper openings in the outer portion of the upper surface of the base member are adapted to receive beverage containers. A continuous groove in the upper surface separates the inner portion from the outer portion. A plurality of resilient tabs are connected to the lower surface. A plurality of legs are adapted to be received by the lower openings and are adapted to be received by the resilient tabs when not received by the lower openings.

Other advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

DETAILED DESCRIPTION OF THE INVENTION

Figure 1:
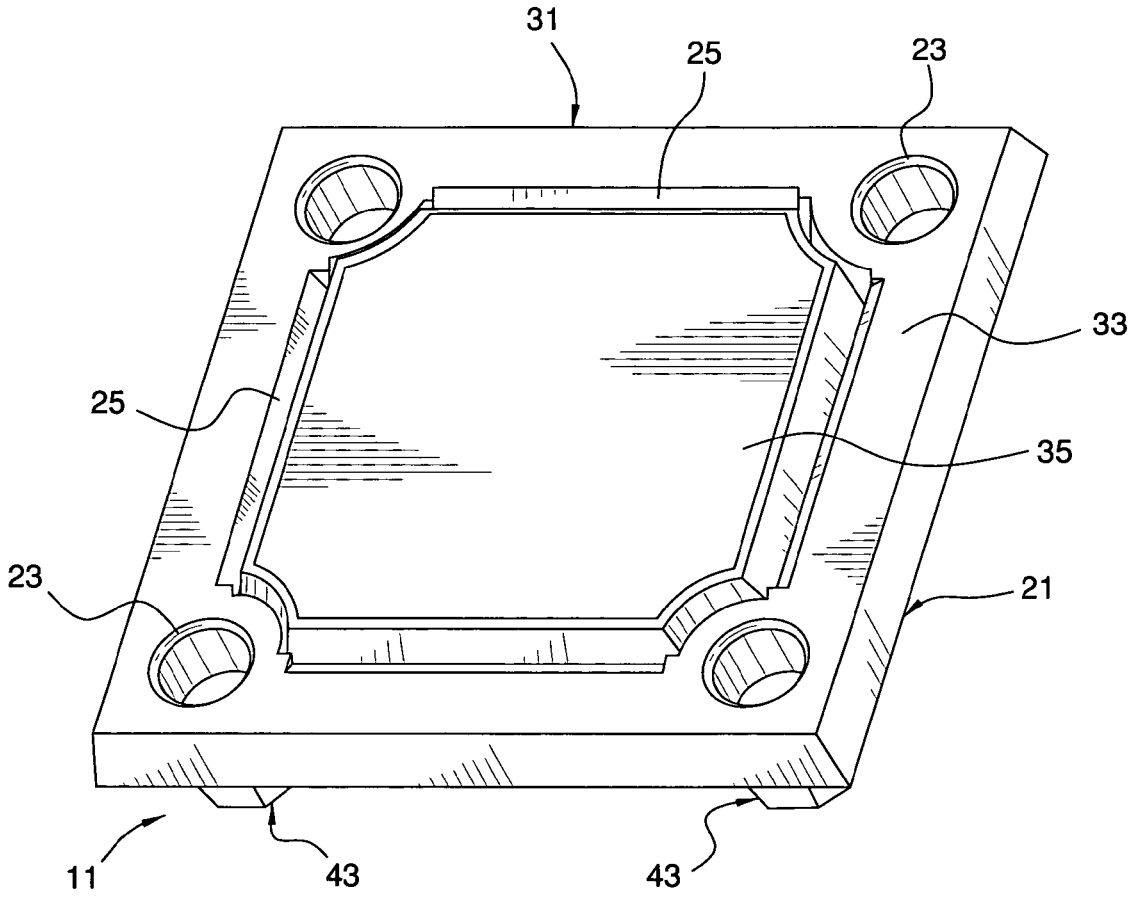
FIG. 1 is a perspective view of upper surface of the amphibious table of the present invention.

A floating amphibious game table 11 is provided that may be used on both land and water, as shown in FIGS. 1–7. The game table 11 has a base member 21 that has an upper surface 31 and a lower surface 41. A plurality of upper openings 23 in the upper surface 31 of the base member 21 are adapted to receive beverage containers. A plurality of lower openings 42 in the lower surface 41 of the base member 21 are adapted to receive a plurality of legs 51. The game table 11 floats to allow for use on water. The game table 11 has a plurality of lower openings adapted to receive a plurality of legs 51 to allow for use on land.

Figure 2:
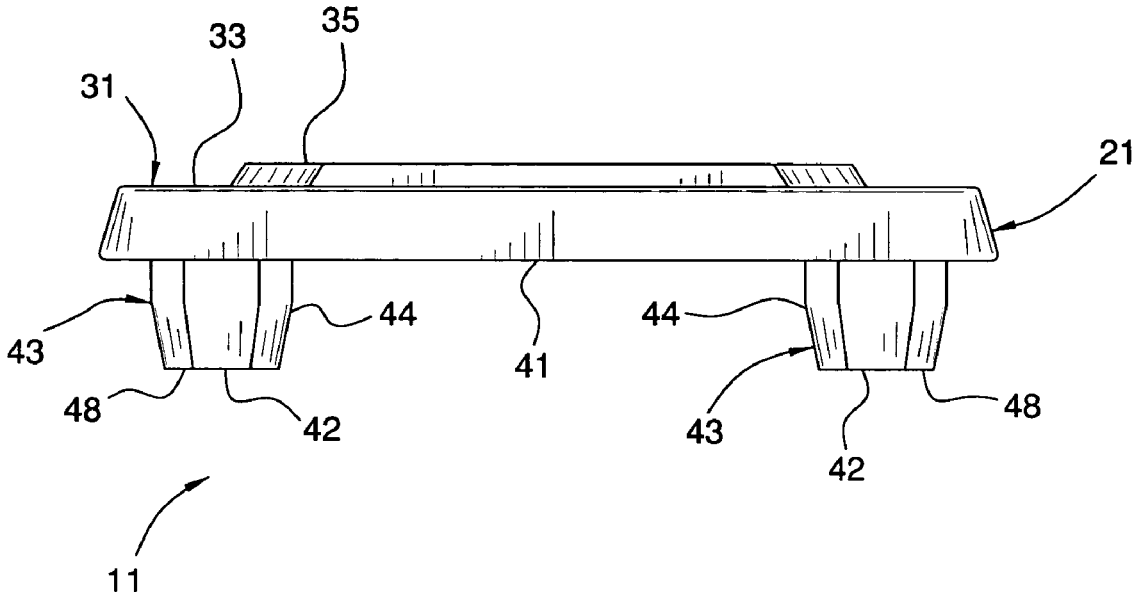
FIG. 2 is a side elevational view of the amphibious table of FIG. 1.
Figure 3:
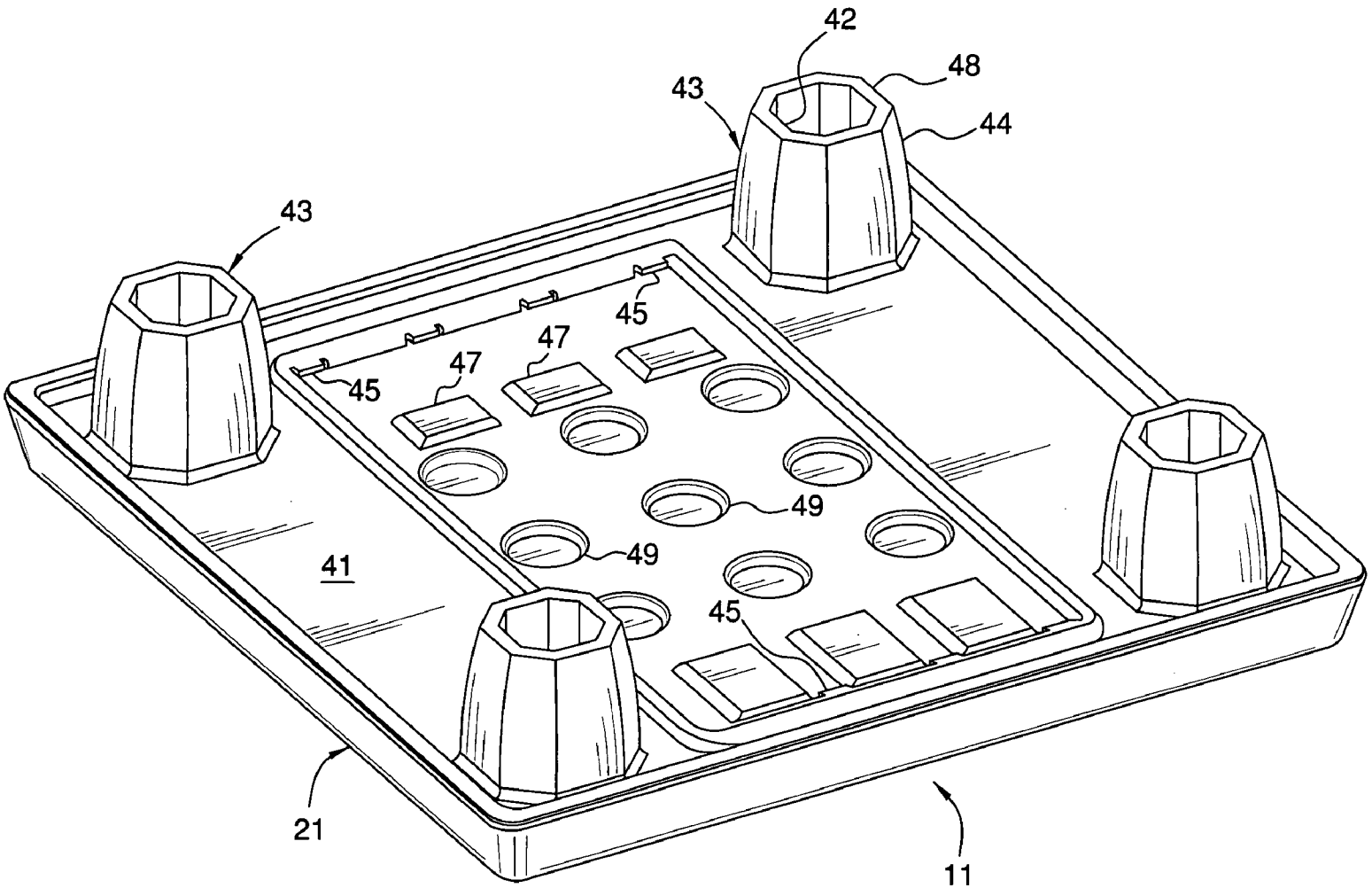
FIG. 3 is a perspective view of the lower surface of the amphibious table of FIG. 1 showing the resilient tabs.
Figure 4:
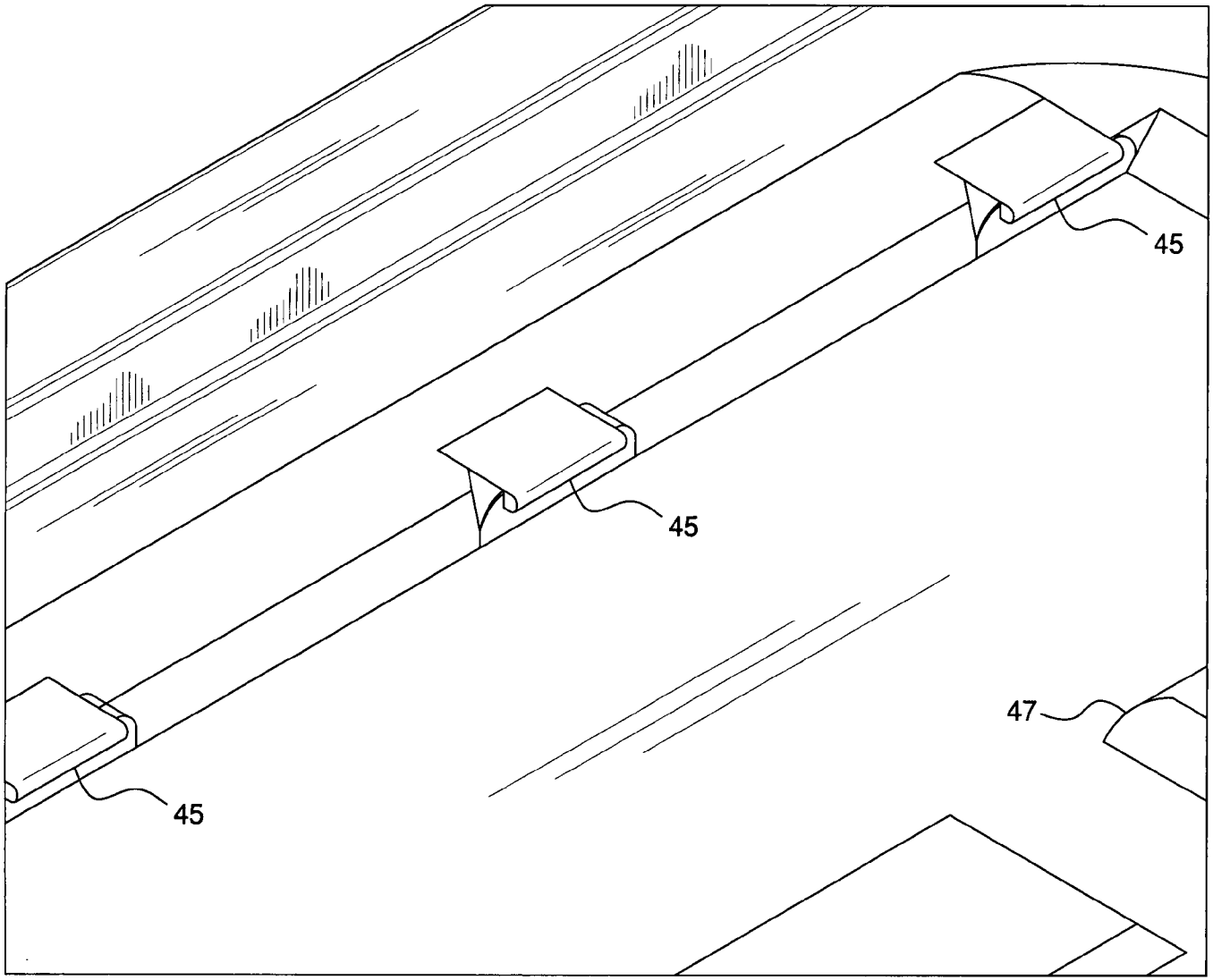
FIG. 4 is an enlarged perspective view of the resilient tabs on the lower surface of FIG. 3.

The base member 21, as shown in FIGS. 1–3, has an upper surface 31 and a lower surface 41. The upper surface 31 has an outer portion 33 and an inner portion 35. Preferably, the inner portion 35 of the upper surface 31 is higher than the outer portion 33, as shown in FIG. 2. The inner portion 31 is substantially planar for use as a game surface, such as for receiving a playing board or cards. A continuous groove 25 separates the outer and inner portions of the upper surface. The groove 25 receives game pieces or cards to be used for playing a game on the game table. Preferably, the base member 21 is substantially hollow and can be produced by rotomolding or any other suitable technique. Preferably, the base member 21 is substantially rectangular, as shown in FIG. 1, although the base member may be any shape.

Figure 7:
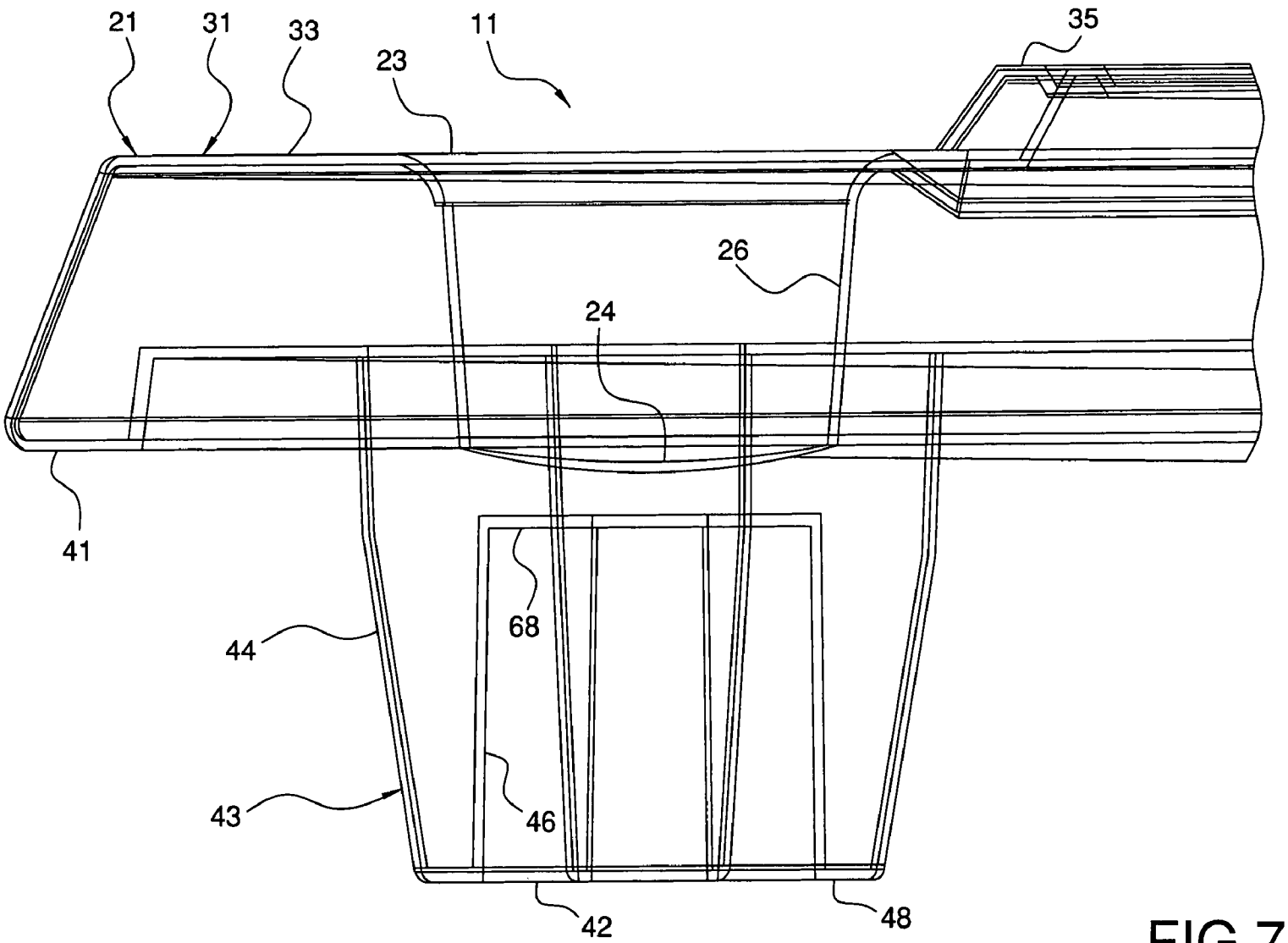
FIG. 7 is a side elevational view in cross-section of the superposed upper and lower openings.

A plurality of upper openings 23 in the upper surface 31 of the base member 21 are adapted to receive beverage containers, as shown in FIGS. 1 and 7. The inner surface 26 of the upper openings 23 tapers inwardly from the opening to the bottom surface 24. As shown in FIG. 1, in a preferred embodiment, an upper opening 23 is located in each corner of the upper surface 31. Preferably, the upper openings 23 are in the outer portion 33 of the upper surface 31 of the base member 21. The upper openings may be any shape, but are preferably circular.

Figure 5:
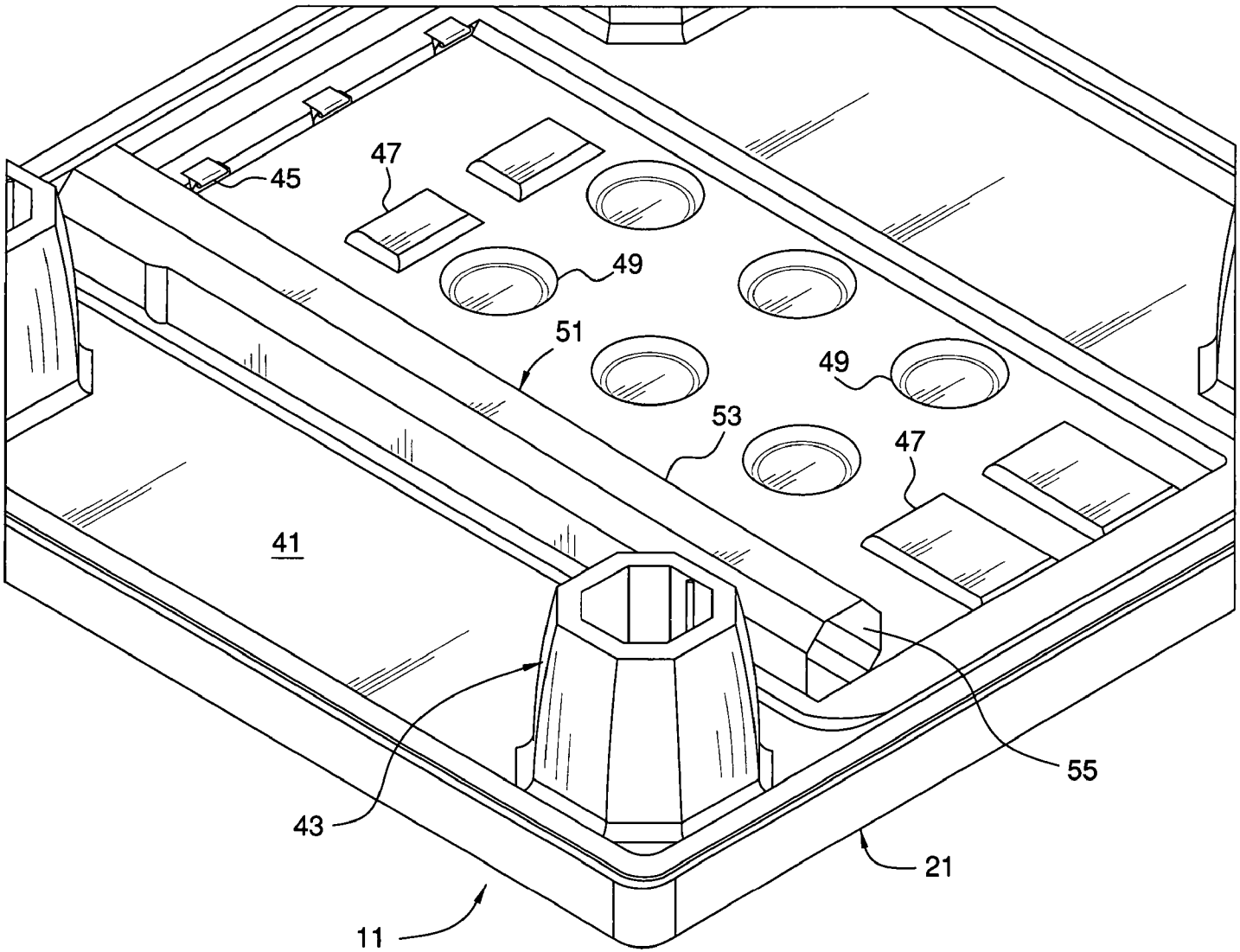
FIG. 5 is a perspective view of lower surface of the amphibious table with a leg received by the resilient tabs.

A plurality of lower openings 42 are located in the lower surface 41 of the base member 21, as shown in FIGS. 3 and 5–7. A plurality of lower protrusions 43 extend downwardly from the lower surface 41 of the base member 21. Preferably, each lower opening 42 is located in a lower protrusion 43, as shown in FIG. 3. The lower protrusions 43 are preferably substantially octagonal with a substantially octagonal opening therein, as shown in FIG. 5. However, the protrusions may be any shape, i.e., circular, rectangular, or the like. The outer surface 44 of the lower protrusion 43 tapers outwardly from the lower surface 41 of the base member 21 toward the bottom surface 48 of the lower protrusion, as shown in FIG. 7. The inner surface 46 of the lower protrusions 43 tapers inwardly from the bottom surface 48 of the lower protrusion toward the upper surface 68 of the lower opening 42. Preferably, the upper openings 23 and the lower openings 42 are substantially superposed, as shown in FIG. 7. Although the upper openings 23 are shown with bottom surfaces 24 and the lower openings 42 are shown with upper surfaces 68, a table according to an embodiment of the present invention may have a continuous passage extending from the upper opening to the lower opening.

Figure 2A:
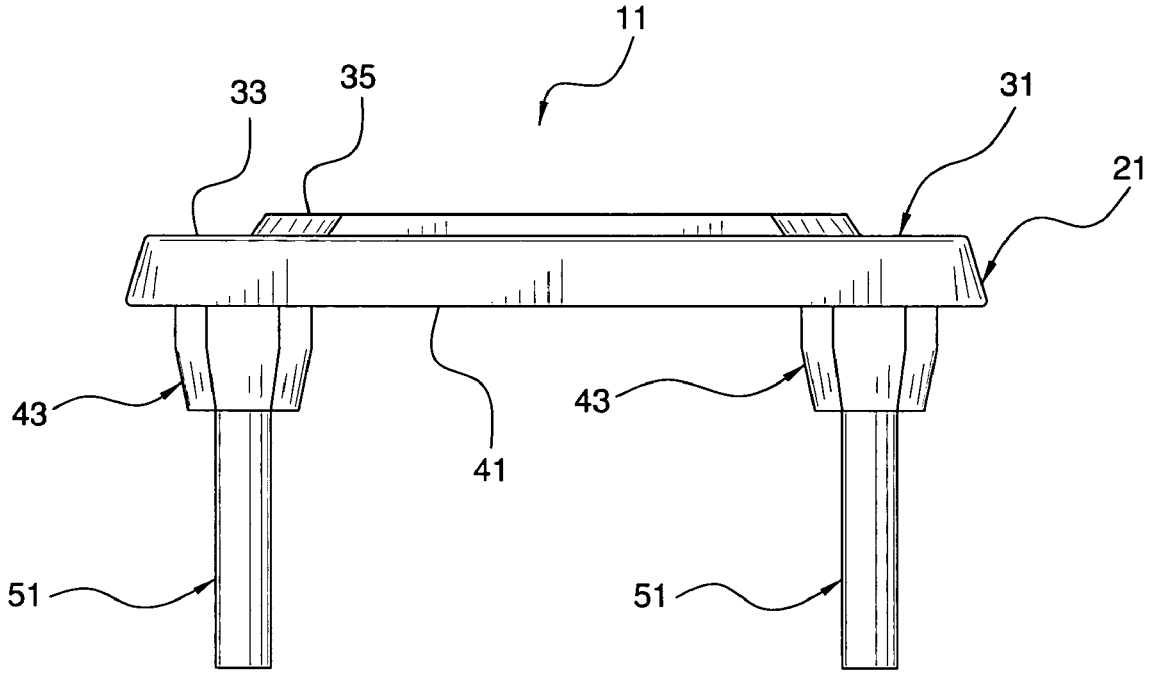
FIG. 2A is a side elevational view of the amphibious table of FIG. 1 with the legs inserted in the lower openings.

A plurality of legs 51 are adapted to be received by the plurality of lower openings 42, as shown in FIG. 2A. The legs 51 have an outer surface 53 and an inner surface 55. The leg is inserted into a lower opening 42 so that a friction fit between the outer surface 53 of the leg 51 and the inner surface 46 of the lower protrusion 43 secures the leg within the protrusion. The legs 51 are substantially perpendicular to the inner portion 35 of the upper surface 31 when received by the lower openings 42.

Figure 6:
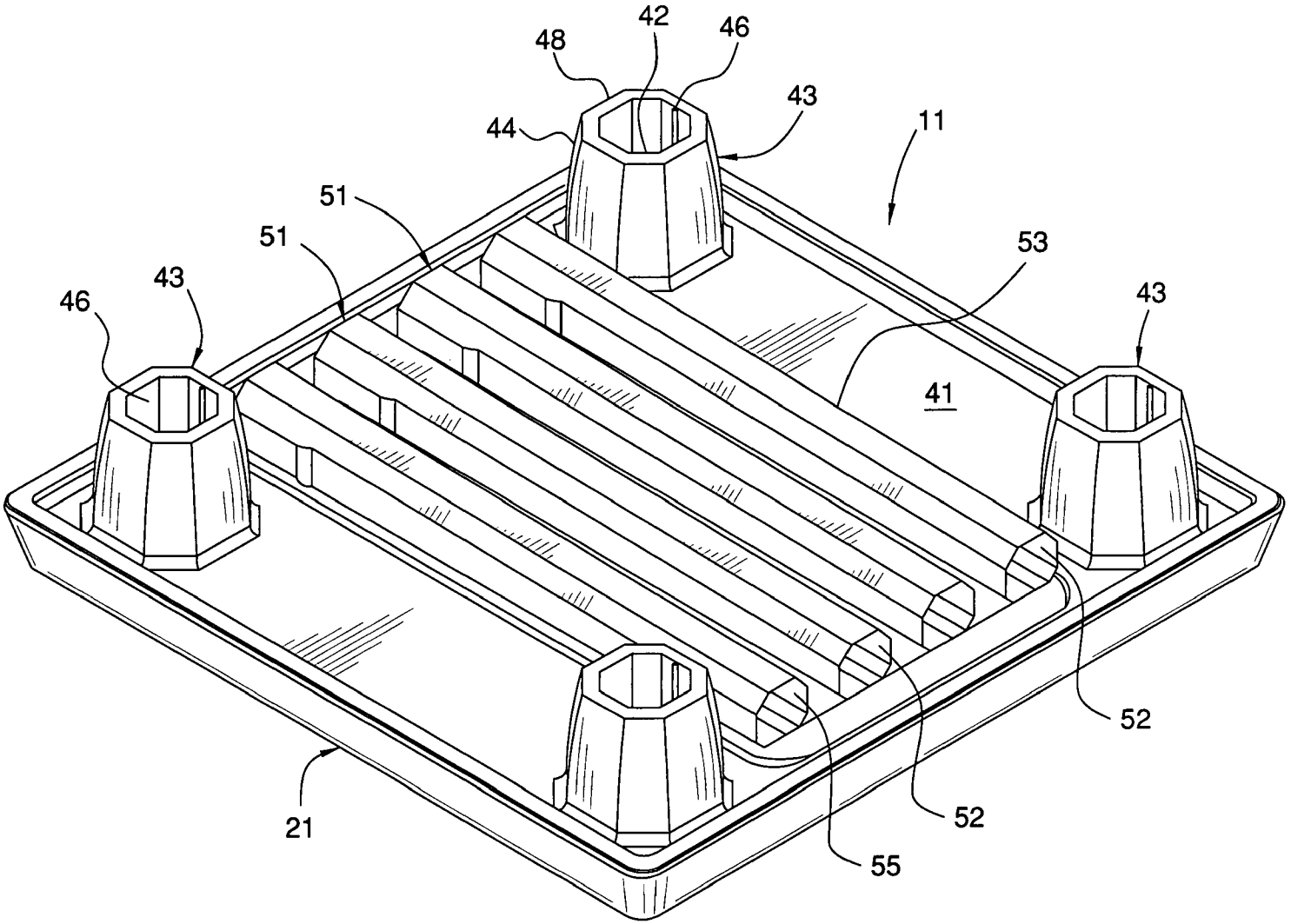
FIG. 6 is a perspective view of the lower surface of the amphibious table with four legs received by the resilient tabs.

The legs 51 may alternatively be secured to the game table 11 by any suitable means, including by means of a snap fit, pressure fit, or use of fasteners, e.g., "Velcro". For example, a plurality of resilient tabs 45 may be provided to secure the legs on the lower surface 41 of the table when not being received by the lower openings 42. Each leg has a pair of resilient tabs 45 for securing the leg, as shown in FIG. 6. The resilient tabs 41 contact the inner surface 55 of the leg when securing the leg to the table. A plurality of side mounts 47 may also be provided to facilitate securing the legs 51 to the table with the resilient tabs 45. The side mounts 47 contact the outer surface 53 of the legs, thereby providing a friction fit between the side mounts 47 and the legs 51. Preferably, each of the legs 51 is parallel to one another when secured by the resilient tabs 45.

A plurality of recesses 49 extend upwardly from the lower surface 41 of the base member 21, as shown in FIGS. 3 and 5. The upwardly extending recesses 49 provide rigidity and structural integrity to the base member 21. The recesses 49 bring that portion of the lower surface 41 in closer proximity to the upper surface 31 to increase the rigidity and structural integrity of the game table, thereby preventing collapsing or flexing of the upper surface 31.

Preferably, the base member 21, the plurality of protrusions 43, and the plurality of resilient tabs 45 are unitarily formed, such as by rotational molding. Preferably, the base member 21 is made of a non-cellular material, such as, but not limited to, fiberglass and plastic.

ASSEMBLY AND DISASSEMBLY

The game table 11 is amphibious so that it may be used on both land and water. The game table of the present invention is hereinafter described as having four legs 51, four lower openings 42, four lower protrusions 43 and four pairs of resilient tabs 45, although the present invention is not so narrowly limited and any number of these features is possible.

The four legs 51 are adapted to be received by the four pairs of resilient tabs 45, as shown in FIG. 3. As a leg 51 is pressed into a pair of resilient tabs 45, the outer surface 53 of the leg causes the tabs to bend outwardly. Once the outer surfaces of the leg 51 have passed the pair of resilient tab 45, they snap back to their original position. The resilient tabs 45 then extend into the interior 52 of the leg 51 proximal the inner surface 55 to prevent the leg from passing by the resilient tabs in the opposite direction, thereby storing the leg between a pair of resilient tabs. The tabs 45 prevent the legs 51 from accidentally or inadvertently being removed. Side mounts 47 further facilitate retention of the legs 51 by the resilient tabs as well as maintaining substantially parallel alignment between each of the legs. As shown in FIG. 6, the legs 51 are stored along the lower surface 41 of the game table so that each of the legs are substantially parallel to one another and substantially parallel to the lower surface. In this configuration, the floating amphibious game table 11 may be used in a water environment.

When the game table 11 is desired to be used on land, the four legs are removed from resilient tabs 45. Pulling the legs 51 away from the resilient tabs 45 causes the resilient tabs to bend outwardly, thereby allowing the legs to be removed. Each leg 51 is then inserted in a lower opening 42 in a lower protrusion 43 as shown in FIG. 2A. The inwardly tapering inner surface 46 of the lower protrusion 43 provides an interference fit with the leg 51. The legs 51 are received by the lower protrusions so that each leg is substantially perpendicular to the lower surface 41 of the game table. In this configuration, the floating amphibious game table 11 may be used on land.

The inner portion 35 of the upper surface 31 provides a playing surface for the game table. The inner portion may receive a board for a board game or be used as surface for playing cards. The continuous groove 25 may be used to receive game pieces for the board game, or to receive cards for card games. Upper openings 23 in the upper surface 23 may receive beverage containers being used by players.

The ease of moving the legs 51 between the configuration where they are secured by the resilient tabs (FIG. 6) to the configuration where they are received by the lower openings (FIG. 2A) provides a floating amphibious game table that is readily usable on both land and water. The plurality of upwardly extending recesses 49 in the lower surface 41 provide rigidity and structural integrity to the game table 11 so that it may be used on both land and water without collapse or flexing of the upper surface 31.

While advantageous embodiments have been chosen to illustrate the invention, it will be understood by those skilled in the art that various changes and modifications may be made therein without departing from the scope of the invention as defined in the appended claims.

What is claimed is:

1. A floating amphibious table, comprising:

a base member having an upper surface and a lower surface, said upper surface and said lower surface being spaced apart and connected by a lateral wall, so as substantially surround and thereby define a substantially enclosed space therebetween, said enclosed space being substantially hollow over at least a majority of said base member;

a plurality of upper openings in the upper surface of the base member adapted to receive beverage containers;

said lower surface of the base member being provided with a plurality of lower openings; and a plurality of legs adapted to be received by said plurality of lower openings, wherein said plurality of legs are adapted to be received in said plurality of lower openings for use of said floating amphibious table on land and said plurality of legs are adapted to be removable from said plurality of lower openings for use of said floating amphibious table in water.

2. The floating amphibious table of claim 1, wherein said table is a game table.

3. A floating amphibious table according to claim 2, wherein said plurality of lower openings are substantially superposed with said plurality of upper openings.

4. A floating amphibious table according to claim 2, wherein said lower surface of said base member has a plurality of resilient tabs adapted to receive said plurality of legs when not received by said lower openings.

5. A floating amphibious table according to claim 4, wherein each of said plurality of legs are substantially parallel to one another when received by said plurality of resilient tabs.

6. A floating amphibious table according to claim 4, wherein said plurality of legs have inner and outer surfaces and first and second ends.

7. A floating amphibious table according to claim 6, wherein said plurality of resilient tabs engage said inner surfaces at said first and second ends of said plurality of legs to retain said plurality of legs when received by said plurality of resilient tabs.

8. A floating amphibious table according to claim 2, wherein a plurality of protrusions extend downwardly from said lower surface and have said plurality of lower openings therein.

9. A floating amphibious table according to claim 8, wherein said plurality of protrusions have an inwardly tapering inner wall extending upwardly from said plurality of lower openings for frictionally engaging said plurality of legs.

10. A floating amphibious table according to claim 8, wherein said lower surface has four protrusions.

11. A floating amphibious table according to claim 8, wherein said base member has a substantially rectangular cross-section.

12. A floating amphibious table according to claim 11, wherein one of said plurality of protrusions and one of said upper openings are positioned in each corner of said base member.

13. A floating amphibious table according to claim 2, wherein said upper surface of said base member has an inner portion higher than an outer portion.

14. A floating amphibious table according to claim 13, wherein a continuous groove separates said inner portion from said outer portion of said upper surface of said base member.

15. A floating amphibious table according to claim 13, wherein a plurality of upwardly extending recesses are formed in said lower surface to support and provide structural integrity to said inner portion of said upper surface of said base member.

16. A floating amphibious table according to claim 13, wherein said inner portion is substantially planar.

17. A floating amphibious table according to claim 2, wherein said amphibious table has four legs.

18. A floating amphibious table according to claim 2, wherein said plurality of legs are substantially octagonal in cross-section.

19. A floating amphibious table according to claim 2, wherein said plurality of upper openings are substantially circular.

20. A floating amphibious table according to claim 2, wherein said plurality of lower openings are substantially octagonal.

21. A floating amphibious table according to claim 2, wherein said base member is made of a non-cellular material.

22. A floating amphibious table according to claim 21, wherein said non-cellular material is selected from the group consisting of fiberglass and plastic.

23. A floating amphibious table, comprising:

a base member having an upper surface and a lower surface, said upper surface and said lower surface being spaced apart and connected by a lateral wall so as to substantially surround and thereby define a substantially enclosed space therebetween, said enclosed space being substantially hollow over at least a majority of said base member;

said lower surface of said base member being provided with a plurality of lower openings; and a plurality of legs adapted to be received by said lower openings when said table is used on land.

24. A table according to claim 23, wherein said upper surface has an inner portion and an outer portion, said inner portion being higher than said outer portion.

25. A table according to claim 24, wherein a plurality of upper openings in said outer portion of said upper surface of said base member are adapted to receive beverage containers.

26. A table according to claim 25, wherein said base member, said plurality of protrusions and said plurality of resilient tabs are unitarily formed.

27. A table according to claim 25, wherein said base member is made of a non-cellular material.

28. A table according to claim 27, wherein said non-cellular material is selected from the group consisting of fiberglass and plastic.

29. A table according to claim 25, wherein said amphibious table has four protrusions.

30. A table according to claim 25, wherein said amphibious table has four legs.

31. A table according to claim 25, wherein said plurality of legs are substantially octagonal.

32. A table according to claim 25, wherein said plurality of upper openings are substantially circular.

33. A table according to claim 25, wherein said plurality of lower openings are substantially octagonal.

34. A table according to claim 24, wherein a plurality of upwardly extending recesses are formed in said lower surface to support and provide structural integrity to said inner portion of said upper surface of said base member.

35. A table according to claim 23, wherein a plurality of resilient tabs are connected to said lower surface, said plurality of resilient tabs being adapted to retain said plurality of legs when said table is used in water.

36. A table according to claim 35, wherein each of said plurality of legs are substantially parallel to one another when received by said plurality of resilient tabs.

37. A table according to claim 36, wherein a plurality of side mounts engage said outer surfaces of said plurality of legs to facilitate retention of said plurality of legs when received by said plurality of resilient tabs.

38. A table according to claim 23, wherein said base member is substantially rectangular in cross-section.

39. A table according to claim 38, wherein one of said plurality of protrusions and one of said plurality of openings is positioned in each corner of said base member.

40. A floating amphibious game table, comprising:

a substantially hollow base member having an upper surface and a lower surface, said upper surface having an inner portion and an outer portion, said inner portion being higher than said outer portion;

a continuous groove in said upper surface separating said inner portion from said outer portion;

four upper openings in said outer portion of said base member adapted to receive beverage containers;

four lower protrusions integral with and extending downwardly from said lower surface of said base member and substantially superposed with said four upper openings;

four lower openings in each of said four lower protrusions;

four pairs of resilient tabs on said lower surface;

four legs adapted to be received by said four lower openings and adapted to be received by said four pairs of resilient tabs when not received by said four lower receptacles; and a plurality of upwardly extending recesses in the lower surface of the base member to provide support and structural integrity to said inner portion of said upper surface of said base member.

41. A floating amphibious game table according to claim 40, wherein each of said plurality of legs are substantially parallel to one another when received by said plurality of resilient tabs.

42. A floating amphibious game table according to claim 41, comprising:

a plurality of side mounts for engaging said outer surfaces of said plurality of legs to facilitate retention of said plurality of legs when received by said plurality of resilient tabs.

43. A floating amphibious game table according to claim 40, wherein said inner portion of said upper surface of said base member is substantially planar.

44. A floating amphibious game table according to claim 40, wherein said base member is made of a non-cellular material.

45. A floating amphibious game table according to claim 44, wherein said non-cellular material is selected from the group consisting of fiberglass and plastic.

46. A floating amphibious game table according to claim 40, wherein said base member, four lower protrusions and four pair of resilient tabs are unitarily formed.

47. A floating amphibious game table according to claim 40, wherein said recesses are proximal to said inner portion of said upper surface of said base member.

48. A floating amphibious game table according to claim 40, wherein said table is made by rotomolding.

49. A method of using a floating amphibious game table, comprising:

removably attaching a plurality of legs to the game table to support the game table for use on land, the game table having upper and lower surfaces, said upper surface and said lower surface being spaced apart and connected by a lateral wall so as to substantially surround and thereby define a substantially enclosed space therebetween, the enclosed space being substantially hollow over at least a majority of the base member;

removing the plurality of legs from the table when using the table in water; and floating the game table in water.

50. A method of using a floating amphibious game table according to claim 49, further comprising positioning beverage containers in a plurality of upper openings in the upper surface of the game table.

51. A method of using a floating amphibious game table according to claim 49, further comprising removably attaching the plurality of legs to a plurality of resilient tabs disposed on the lower surface of the table adapted to retain the plurality of legs.

* * * * *